US005505220A

United States Patent [19]

Gorecki

[11] Patent Number: 5,505,220

[45] Date of Patent: Apr. 9, 1996

[54] DUAL TANGENTIAL SPRAY PAINT ROLLER CLEANER

[76] Inventor: Joseph D. Gorecki, 78 Poquito Rd., Shalimar, Fla. 32579

[21] Appl. No.: 409,145

[22] Filed: Mar. 23, 1995

[51] Int. Cl.[6] ..... B08B 3/02

[52] U.S. Cl. ..... 134/138; 134/900

[58] Field of Search ..... 134/138, 139, 134/900

[56] References Cited

U.S. PATENT DOCUMENTS

| | | | |
|---|---|---|---|
| 3,133,548 | 5/1964 | Carr | 134/138 |
| 3,587,599 | 6/1971 | Bywater | 134/138 |
| 3,886,960 | 6/1975 | Krueger | 134/138 |
| 4,142,540 | 3/1979 | Vegiard | 134/138 |
| 4,377,175 | 3/1983 | Fritz | 134/900 X |
| 4,641,673 | 2/1987 | Conley et al. | 134/900 X |
| 4,809,722 | 3/1989 | Pennise | 134/138 |
| 4,832,066 | 5/1989 | Shipman | 134/900 X |
| 5,033,491 | 7/1991 | Middleton | 134/138 |
| 5,337,769 | 8/1994 | Howe | 134/900 X |
| 5,363,869 | 11/1994 | McDowell | 134/900 X |

*Primary Examiner*—Philip R. Coe
*Attorney, Agent, or Firm*—Peter Loffler

[57] ABSTRACT

The present invention relates to an apparatus for cleaning various types of paint from a conventional paint roller cover without the necessity of removing the cover from their paint roller handle. The device includes a cylindrical containment vessel having a paint-roller-handle access slot, an access-slot spray shield, four support legs, a hinged lid, a transport handle, a cleaning solution supply valve, a drain valve, and a pair of parallel and longitudinally disposed spray bars. The two spray bars direct streams of water under pressure tangentially to opposite sides of the paint roller cover, that is manually positioned in a plane halfway between them. This causes the paint roller cover to rotate at a high velocity on its axis and thereby clean the roller cover by the water and centrifugal force thus generated. Water is supplied to the device by means of a standard garden hose which is connected to an exterior fitting of the supply valve.

2 Claims, 4 Drawing Sheets

DUAL TANGENTIAL SPRAY PAINT ROLLER CLEANER

BACKGROUND OF THE INVENTION

1. Field of the Invention

The present invention relates to paint applicator cleaning devices, and in particular, to those devices that are used to clean various types of paints from conventional paint roller covers.

2. Background of the Prior Art

Conventional paint rollers are used extensively by painters to apply latex and oil-based paints to a variety of surfaces both interior and exterior. As the paint is absorbed deeply into the sub-layers, cleaning the roller cover is difficult. Traditional methods of paint roller cover cleaning involve either immersing the roller cover several times into a container of appropriate cleaning solution or utilizing a stream of the solution to cleanse the roller cover. If the paint being utilized is a water-based latex, the cover can be soaked in water and then rinsed off under a water faucet or garden house. If an oil-based paint is used, the cover can be soaked and rinsed in paint thinner, turpentine, acetone or other similar solution. With these methods, not only is it difficult to remove the paint from the cover, but removal is messy, time consuming and inefficient. Consequently, the used paint roller is discarded and a new cover is used for the next application.

Recently, two types of cleaning devices have been utilized in the art to clean conventional paint roller covers. The first type of device employs an annular ring or close fitting cylindrical sheath to direct a flow of water uniformly down the length of the roller cover, diluting the paint residue adhering to the roller cover and allowing the paint to flow—aided by gravity—off the opposite end of the roller. However, this method is still messy, time consuming and inefficient. This type of device often leaves a substantial amount of paint residue near the sub-layers of the roller cover and also requires the user's assistance in moving the roller cover through the annular ring or close fitting cylindrical sheath.

The second type of paint roller cover cleaning device utilizes a jet or spray of water directed against the surface of the roller cover causing the cover to rotate on its longitudinal axis and throw the paint off. In some of these devices, the jet or spray is directed through a single spray bar oriented along the longitudinal axis of the device. Any additional jet or spray of water only provides a cleansing stream and does not operate to rotate the roller cover. Variations of this second type of cleaning device come with the requirement of removing the roller cover from the roller handle and mounting the cover on a spindle located inside the cleaning device.

These types of devices are more efficient than both the traditional cleaning methods and the above-mentioned first type of cleaning device. However, these devices are inefficient in that not all the cleansing water is utilized to rotate the roller cover, thereby limiting the available centrifugal force that causes the paint residue to be eliminated from the roller cover. This deficiency leaves the roller cover saturated with paint residue and cleaning solution. Furthermore, the devices that require roller cover removal are still messy and time consuming.

For the foregoing reasons, there is a need for a paint roller cover cleaning device that is easy and inexpensive to manufacture, easy to use, minimizes the mess associated with the cleaning process, maximizes the centrifugal force created by the cleaning water application, and does not require the removal of the roller cover from the paint roller handle.

SUMMARY OF THE INVENTION

The present invention is directed to a device that satisfies the aforementioned need and provides an efficient and thorough method for cleaning latex and oil-based paints from a conventional paint roller cover without the need to remove the roller cover from the paint roller handle. Paint roller covers cleaned in this manner emerge from the device clean, virtually dry and ready for immediate reuse or storage.

The device of the present invention comprises a cylindrical containment vessel having a paint-roller-handle access slot, an access-slot spray shield, four support legs, a hinged lid, a transport handle, a cleaning solution supply valve, a drain valve, and a pair of parallel and longitudinally disposed spray bars.

The cylindrical containment vessel is closed at one end and is fitted with a hinged lid assembly on the opposing end. The four support legs built into the closed end provide vertical stability and the transport handle mounted on the outer sidewall of the vessel provides portability. The paint-roller-handle access slot is a narrow longitudinal slot cut into the upper sidewall of the vessel and accommodates and positions the shaft of a standard paint roller handle. The access slot allows introduction into and removal from the vessel of a roller cover mounted on a paint roller handle. The access slot is protected by a spray shield which works in conjunction with the hinged lid assembly to prevent paint residue and water splatter during the cleaning operation.

The cleaning solution supply valve is built into the lower exterior sidewall of the vessel and controls the flow of cleaning solution to the two parallel spray bars located inside the vessel. In the preferred embodiment, the valve allows the attachment of a standard garden hose which provides a source of pressurized water as the cleaning solution. However, cleaning solutions other than water can be utilized. In such cases, the water stream from the garden hose can be passed through an appropriate solution mixing device before being attached to the device. Alternately, a pressurized solution source other than from a garden house can be utilized. Each spray bar contains a plurality of staggered holes which direct a high pressure spray pattern tangent to opposite sides of the paint roller cover. The longitudinal axis of the roller cover is positioned in a plane halfway between the longitudinal axes of the spray bars.

The application of the tangential water spray emanating from the spray bars causes the roller cover to turn at a high rotational velocity creating a centrifugal force on the roller cover. This force throws the paint/water mixture from the roller sleeve thereby cleaning the roller cover. At the end of the cleaning cycle the lid portion of the hinged lid assembly is opened and the paint roller handle is manually withdrawn from the containment vessel while the roller is still rotating at a high rotational velocity. The remaining clean water on the paint roller is spun off and trapped inside the vessel in the space between the top of the spray bars and the frame of the hinged lid assembly. As a result, the paint roller cover emerges from the vessel clean and virtually dry.

A drain port built into the lower sidewall of the containment vessel allows the paint/water mixture to be discharged from the interior of the vessel.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
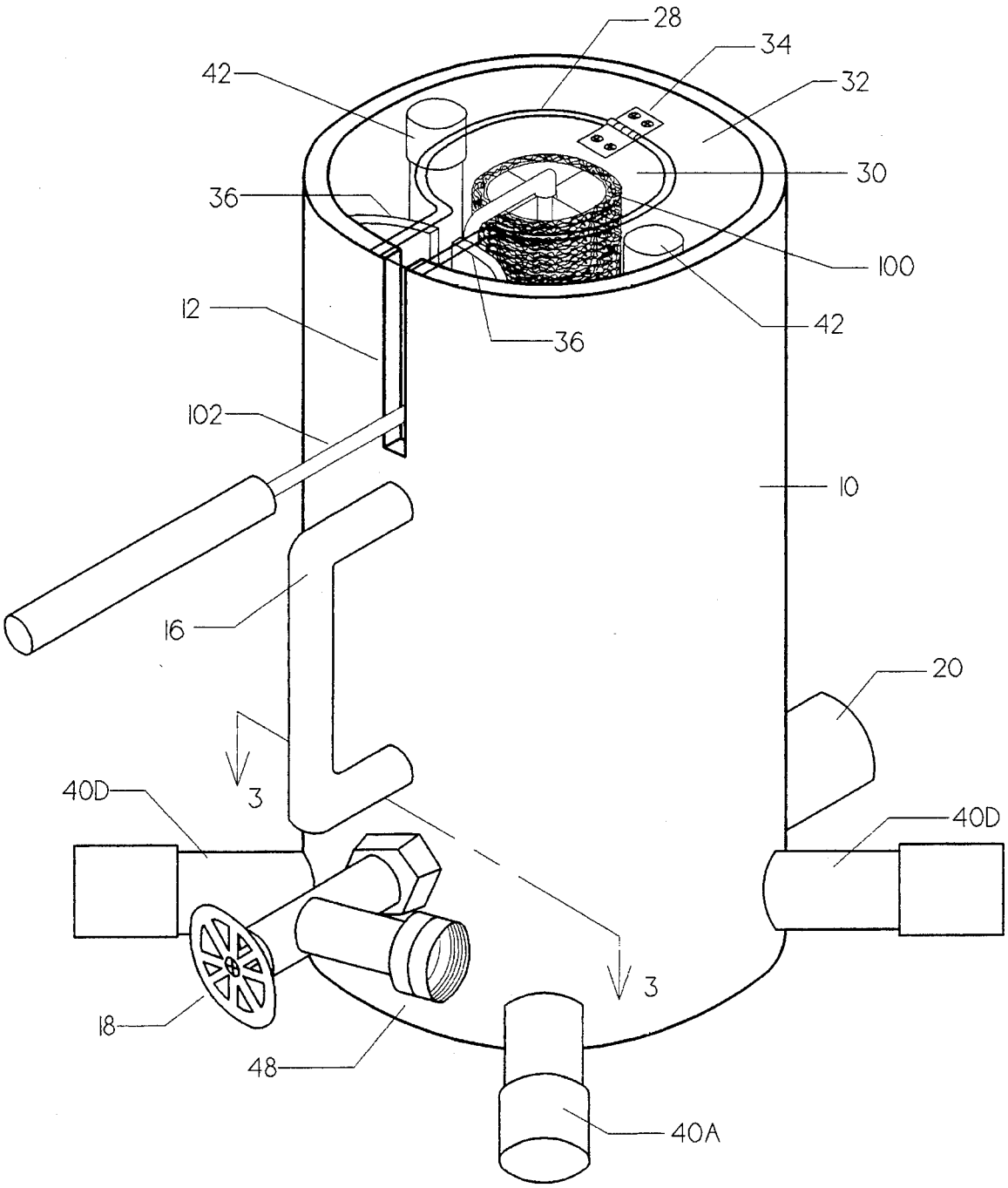
FIG. 1 is a perspective view of the paint roller cleaner of the present invention.
Figure 2:
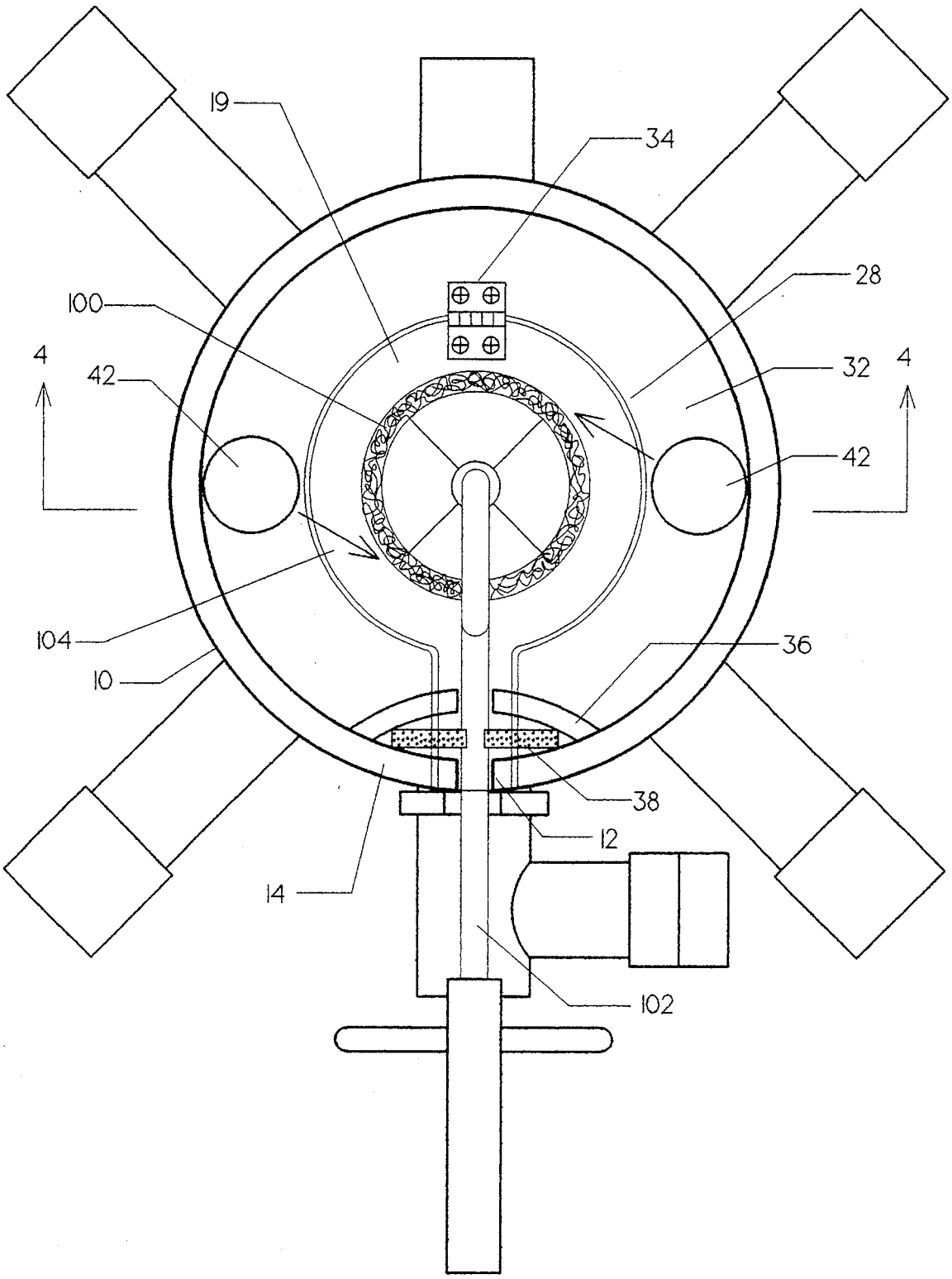
FIG. 2 is a top plan view of the paint roller cleaner of the present invention.
Figure 3:
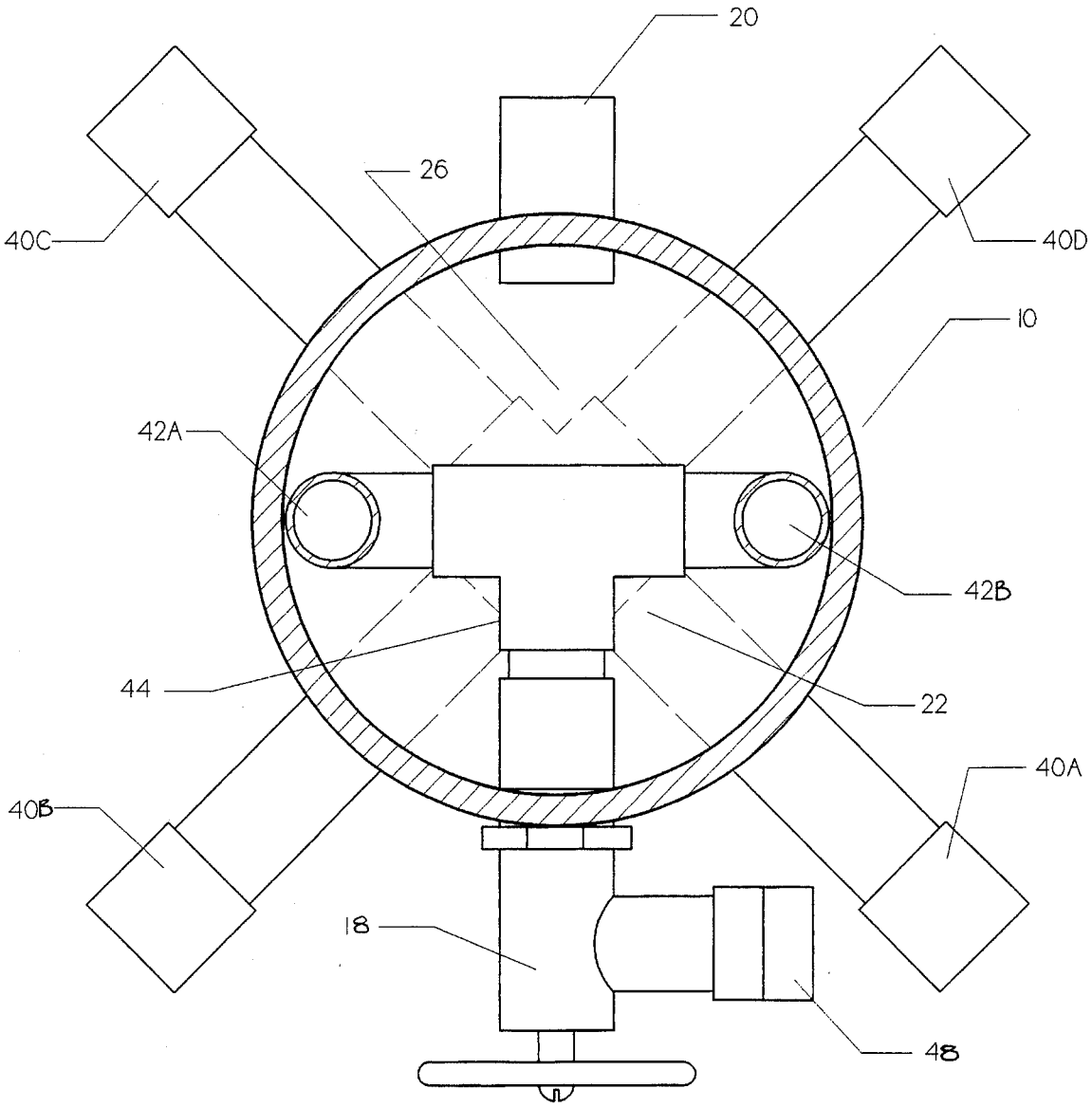
FIG. 3 is a cross-sectional top plan view taken at line 3—3 of FIG. 1.
Figure 4:
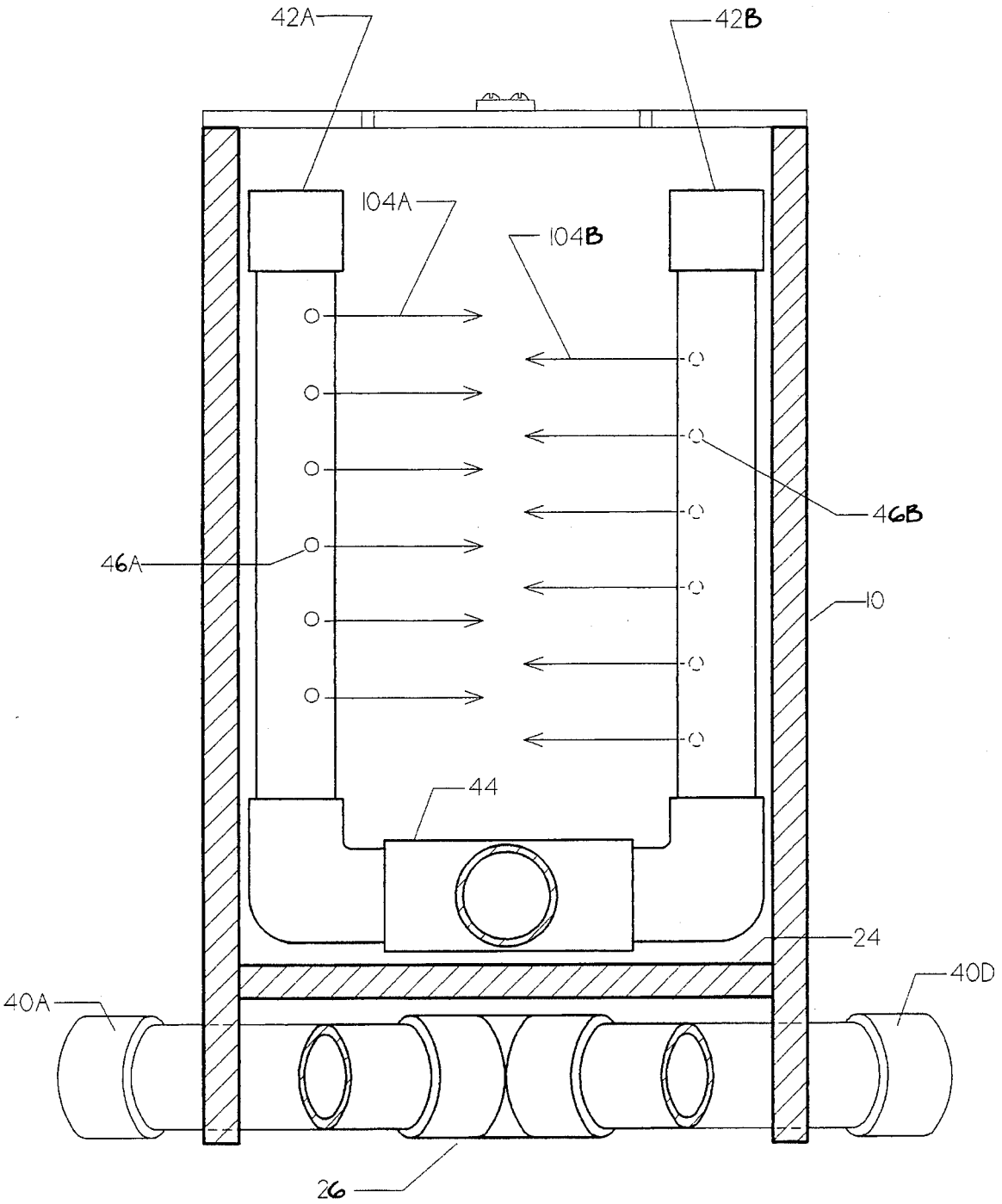
FIG. 4 is a cross-sectional elevation view taken at line 4—4 of FIG. 2.

The paint roller cleaner of the present invention comprises a cylindrical containment vessel 10 having a paint-roller-handle access slot 12, an access slot spray shield assembly 14, a transport handle 16, a water supply valve 18, a drain port 20, and a spray bar assembly 22.

The containment vessel 10 is cylindrically shaped and has a circular closure panel 24 located adjacent the bottom end of the vessel 10. The closure panel 24 is located just below the spray bar assembly 22 and directly above the support leg assembly 26. The vessel 10 is sealed at the bottom by closure panel 24 and is fitted with a lid assembly 28 which covers the opposing top end. The lid assembly 28 is circular in shape and consists of a movable lid panel 30 attached to frame component 32 by hinge 34. With the lid panel 30 in the open position a paint roller cover 100 mounted on its paint roller handle 102 can be lowered into the vessel 10.

The upper sidewall of the containment vessel 10 includes a narrow longitudinal access slot 12 to accommodate a paint roller handle 102 which allows the paint roller cover to be introduced into or removed from the vessel 10. The longitudinal access slot 12 is protected by an accessslot spray shield assembly 14 fixed to the interior wall of the vessel 10. This assembly 14 consists of a rigid concave member 36 and an absorption membrane 38, both having a longitudinal slot similar in size, shape and orientation as the access slot 12. The spray shield assembly 14 prevents the water and paint residue spray from exiting the access slot 12 by maintaining a seal around the metal shaft of the paint roller handle 102 regardless of its position in the access slot 12. The spray shield assembly 14 and the lid assembly (when closed) protect the operator from water and paint residue spray during cleaning operation.

The containment vessel 10 is supported by the support leg assembly 26 which is attached to the vessel 10 adjacent the closure panel 24. The support leg assembly 26 is comprised of four support legs 40*a*–40*d* that are attached together to form a "cross" configuration with the center of the assembly being aligned with the longitudinal axis of the vessel 10. Each of the legs 40*a*–40*d* is attached to and protrudes through the sidewall of the vessel 10 in order to provide maximum vessel stability.

An U-shaped transport handle 16 is attached to the exterior sidewall of the vessel 10 providing portability of the device.

The spray bar assembly 22 is composed of two spray bars 42*a* & 42*b*, a T-shaped water conduit 44, and a water supply valve 18. The two spray bars 42*a* & 42*b* are attached to two opposing ports of the T-shaped water conduit 44 such that the spray bars 42*a* & 42*b* are perpendicular to the conduit 44. The spray bars 42*a* & 42*b* are oriented within the vessel 10 in a longitudinal and parallel manner. The first spray bar 42*a* includes a plurality of jet orifices 46*a* and the second spray bar 42*b* also includes a plurality of jet orifices 46*b* for spraying water 104*a* & 104*b* tangential to the surface of the roller cover 100. In addition, each of the water jet orifices 46*a* on the first spray bar 42*a* are offset relative to the jet orifices 46*b* on the second spray bar. This ensures that the two sets of jet orifices 46*a* & 46*b* are oriented in separate horizontal planes. This arrangement ensures that the spray patterns 104*a* & 104*b* generated cover the maximum surface area of the paint roller cover 100 positioned between them and imparts the maximum velocity to the paint roller cover 100.

The water supply valve 18 is attached to the vessel sidewall and to the remaining port of the conduit 44 and controls the flow of water to the spray bars 42*a* & 42*b*. The water supply for the device is provided by attaching a garden hose, or other similar water supply means, to the supply valve 18 at the valve junction 48. Valve junction 48 includes matingly engageable threads typical of conventional garden hoses. However, those skilled in the art can see that other connection means, such as snap connect/disconnect hose fittings, are feasible.

The water and paint residue mixture which collects at the bottom of the vessel 10 is allowed to exit through a drain port 20 built into the lower sidewall of the vessel 10. The drain port 20 is positioned immediately above closure panel 24.

In operation, a paint roller cover 100 is loaded into the device by opening the lid panel 30 and inserting the paint roller handle 102 into the access slot 12. Once the paint roller cover 100 is positioned between the spray bars 42*a* & 42*b*, the lid panel 30 is closed and the water supply valve 18 is opened. The application of the water supply 104*a* & 104*b* of the spray bars 42*a* & 42*b* tangential to the paint roller cover 100 causes the roller cover 100 to turn at a high rotational velocity and dilutes the paint residue in the roller cover 100. The centrifugal force generated by the rotation throws the paint residue/water mixture from the roller cover 100, thereby cleaning the roller cover 100.

At the conclusion of the cleaning operation, the lid panel 30 is opened and the paint roller handle 102 is manually withdrawn from the vessel 10. The paint roller cover 100 is still rotating at a high velocity and the clean water adhering to it is spun off the roller cover 100 leaving it virtually dry. The water being spun off is trapped inside the device in the area between the top of the spray bars 42*a* & 42*b* and the frame component 32 of the lid assembly 28.

While the invention has been particularly shown and described with reference to an embodiment thereof, it will be understood by those skilled in the art that various changes in form and detail may be made without departing from the spirit and scope of the invention.

I claim:

1. A paint roller cleaning apparatus, for cleaning paint from a paint roller having a roller handle and a rotatable paint roller cover, comprising:

an elongated cylindrical containment vessel having an enclosed bottom surface and a hinged access panel at the opposing surface;

an access means, attached to said containment vessel, for positioning said roller handle such that said roller cover is oriented along a longitudinal axis of said containment vessel and including a vertical slot cut into said containment vessel in an upper sidewall of said containment vessel;

a water seal means, attached to said containment vessel, for preventing water spray from escaping said containment vessel, and including a split fibrous membrane attached against said upper sidewall of said containment vessel, thereby preventing water from escaping from around said roller handle when said roller handle is being moved up or down in said vertical slot in said upper sidewall;

a water supply conduit means for supplying water to said containment vessel and having a valve for controlling said water;

a first water spray bar means having a plurality of spray nozzles, attached to said water supply conduit means, for spraying water along a longitudinal path and tangentially impacting a first surface of said roller cover;

a second water spray bar means having a plurality of spray nozzles longitudinally staggered from said spray nozzles of said first water spray bar means, attached to said water supply conduit means, for spraying water along a longitudinal path and tangentially impacting a second surface of said roller cover one hundred eighty degrees from said first surface of said roller cover; and a drain means, attached to said containment vessel, for expelling waste water and paint residue from said containment vessel.

2. A paint roller cleaning apparatus, for cleaning paint from a paint roller having a roller handle and a rotatable paint roller cover, comprising:

an elongated cylindrical containment vessel having an enclosed bottom surface and a hinged access panel at the opposing surface;

an access means, attached to said containment vessel, for positioning said roller handle such that said roller cover is oriented along a longitudinal axis of said containment vessel and including a vertical slot cut into said containment vessel in an upper sidewall of said containment vessel;

a water seal means, attached to said access means, for preventing water spray from escaping said containment vessel, and including a split fibrous membrane attached against said upper sidewall of said containment vessel, thereby preventing water from escaping from around said roller handle when said roller handle is being moved up or down in said vertical slot in said upper sidewall;

a water supply conduit means for supplying water to said containment vessel and having a T-shaped conduit configuration;

a valve means, attached to said water supply conduit means, for controlling said water supply conduit means;

a first water spray bar means having a plurality of spray nozzles, attached to said water supply conduit means, for spraying water along a longitudinal path and tangentially impacting a first surface of said roller cover;

a second water spray bar means having a plurality of spray nozzles longitudinally staggered from said spray nozzles of said first water spray bar means, attached to said water supply conduit means, for spraying water along a longitudinal path and tangentially impacting a second surface of said roller cover one hundred eighty degrees from said first surface of said roller cover; and a drain means, attached to said containment vessel, for expelling waste water and paint residue from said containment vessel; and a handle attached to an exterior sidewall of said containment vessel to facilitate portability.

* * * * *